US006467241B1

(12) United States Patent
Odenthal et al.

(10) Patent No.: US 6,467,241 B1
(45) Date of Patent: Oct. 22, 2002

(54) SYSTEM FOR SETTING UP BOXES

(75) Inventors: Heinz F. Odenthal, Zülpich; Bruno Baumeister, Heimbach, both of (DE)

(73) Assignee: Nor-Reg AS, Honefoss (NO)

( * ) Notice: Subject to any disclaimer, the term of this patent is extended or adjusted under 35 U.S.C. 154(b) by 0 days.

(21) Appl. No.: 09/400,384

(22) Filed: Sep. 21, 1999

(30) Foreign Application Priority Data

Sep. 22, 1998 (DE) ..... 198 43 490

(51) Int. Cl.[7] ..... B65B 3/02
(52) U.S. Cl. ..... 53/458; 53/566
(58) Field of Search ..... 53/458, 462, 484, 53/566, 370.3, 376.5, 383.1, 381.1

(56) References Cited

U.S. PATENT DOCUMENTS

| | | | | | |
|---|---|---|---|---|---|
| 3,986,319 | A | * | 10/1976 | Puskarz et al. | 53/207 |
| 4,917,663 | A | | 4/1990 | Pazdernik | |
| 5,148,654 | A | * | 9/1992 | Kisters | 53/462 |
| 5,269,741 | A | | 12/1993 | Fischer | |
| 5,531,661 | A | * | 7/1996 | Moncrief | 53/458 |
| 5,791,124 | A | * | 8/1998 | Spatafora | 53/456 |
| 6,050,063 | A | * | 4/2000 | Ford et al. | 53/458 |
| 6,158,199 | A | * | 12/2000 | Emery, III et al. | 53/442 |

FOREIGN PATENT DOCUMENTS

| | | |
|---|---|---|
| DE | 1198664 | 8/1965 |
| DE | 2641643 | 3/1977 |
| DE | 4027395 | 4/1992 |
| DE | 4322224 | 1/1995 |

* cited by examiner

*Primary Examiner*—John Paradiso
(74) *Attorney, Agent, or Firm*—Herbert Dubno; Andrew Wilford

(57) ABSTRACT

Flat box blanks are set up into boxes by feeding a succession of the blanks one at a time to a setup station and gripping the blanks and pulling them one after another by grippers in a direction without stopping through the station. A plurality of setup tools are moved through the station in the direction synchronously with the grippers and the blanks and are engaged with the continuously moving setup tools transversely with the blanks in the setup station to shape the blanks into boxes while the blanks are held out of contact in the station with any structure other than the synchronously moving tools and grippers.

14 Claims, 4 Drawing Sheets

SYSTEM FOR SETTING UP BOXES

FIELD OF THE INVENTION

The present invention relates to a method of and apparatus for setting up boxes. More particularly this invention concerns a system that takes flat essentially two-dimensional box blanks and erects them into three-dimensional boxes ready for filling.

BACKGROUND OF THE INVENTION

A box blank typically has a plurality of coplanar panels and flaps that are separated by fold lines. Such blanks are delivered to the user in this flat form so they are easy to handle and ship. The user in turn sets them up into the desired three-dimensional shape normally by means of an automatic apparatus that delivers them to an assembly line where they are, for instance, filled.

The setting-up machine receives the flat blanks from a supply, holds it with grippers, and pushes it into shape with various tools. Invariably this procedure is done as the blank travels along a treatment path from the supply to the station where the boxes are filled. To this end the setup tools must of course move perpendicular to the direction of travel of the blank, necessitating some complex coordination of the various conveyors and actuators.

In intermittently operating machines, where the blank is moved in steps through the setup apparatus, each setup tool must move inward transversely of the travel direction into engagement with the blank and then outward completely out of contact with it before the blank can be moved to the next setup station. As a result the blank's travel through the machine is fairly slow, and the equipment is expensive and complex.

In a somewhat faster system there are no transversely displaceable setup tools. Instead the blank is pushed through a set of intricately shaped guides that fold portions sequentially until the desired final shape is achieved. Such a system does not form an accurately shaped box unless an expensive precreased blank is used. In addition sliding the blanks along these guides can scratch the surface of the box, something that is not acceptable when the box has a glossy finish.

German patent document 1 198 664 of Robert Leslie Agar and U.S. Pat. No. 5,269,741 of Wilhelm Fischer describe such systems. Here some of the shaping tools are movable with the workpiece, but much of the folding is done by stationary rails that press against the workpiece. Thus the workpiece slides over these stationary folding rails and, as a result of the relative movement between the blank and the rails, the blank's finish is susceptible to damage as mentioned above. Both systems are also quite complex and extremely difficult to set up to work with blanks of different dimensions.

OBJECTS OF THE INVENTION

It is therefore an object of the present invention to provide an improved system for setting up box blanks.

Another object is the provision of such an improved system for setting up box blanks which overcomes the above-given disadvantages, that is which surely, rapidly, and accurately sets up box blanks without damage to their finish.

SUMMARY OF THE INVENTION

Flat box blanks are set up into boxes according to the invention by feeding a succession of the blanks one at a time to a setup station and gripping the blanks and pulling them one after another by means of grippers in a direction without stopping through the station. A plurality of setup tools are moved through the station in the direction synchronously with the grippers and the blanks and are engaged with the continuously moving setup tools transversely with the blanks in the setup station to shape the blanks into boxes while the blanks are held out of contact in the station with any structure other than the synchronously moving tools and grippers.

Thus with this system the tools and grippers all move with the blanks. Thus they can accurately fold them into boxes without marring their finish. Even relatively complex folding operations, as for instance needed to tuck side-panel end flaps inside the front and back panels, can be carried out accurately and with ease by the moving tools as they travel with the workpieces through the setup station. Since the blanks never stop moving, the apparatus can operate fairly rapidly, producing setup boxes at a great rate.

The apparatus for setting up flat box blanks into boxes has according to the invention a supply or magazine for feeding a succession of the blanks one at a time to a setup station, at least one gripper for gripping the blanks and pulling them one after the other in a direction without stopping through the station, and a plurality of setup tools displaceable in the station transversely of the direction for engaging the blank held in the gripper and passing through the station and folding it into a box. A transport system is connected to the setup tools for displacing them in the direction synchronously with the gripper as the tools fold the blank held by the gripper into a box.

The tools in accordance with the invention include fluid-powered actuators. In addition the transport system includes at least one endless conveyor element having a stretch extending in the direction through the machine and the tools and gripper are mounted on the element. Normally according to the invention a plurality of sets of the tools and respective grippers are mounted on the element. In fact for most efficient operation two such elements flank a path extending in the direction through the station and each such element carries a plurality of sets of tools and respective grippers. To accommodate blanks of different sizes a spacing between the tools in the direction and a spacing between the stretches transverse to the direction can be varied.

The tools include two front tools and two back tools spaced in the direction from the front tools. As the transport element is advanced the front tools precede the back tools.

The system of this invention may also be provided with means for applying an adhesive to flaps of the blank and means for taking set-up boxes from the gripper at a downstream side of the station. The tools themselves have means for stripping set-up boxes from themselves. The apparatus can also have means for closing top panels of the boxes and for feeding objects to be packaged to the station which are set up around the objects to be packaged.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
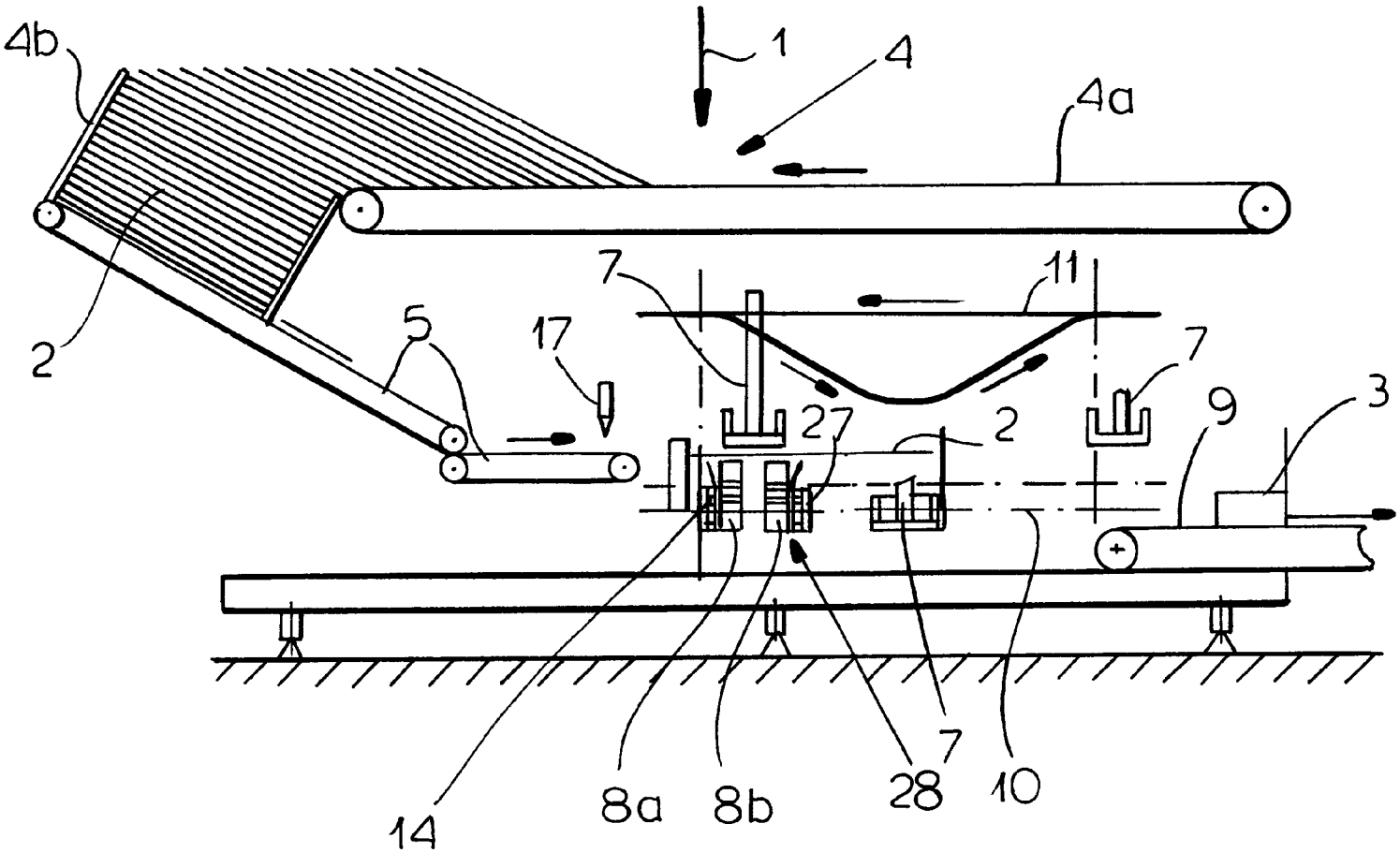
FIG. 1 is a partly diagrammatic side view of the apparatus for carrying out the method of this invention.
Figure 2:
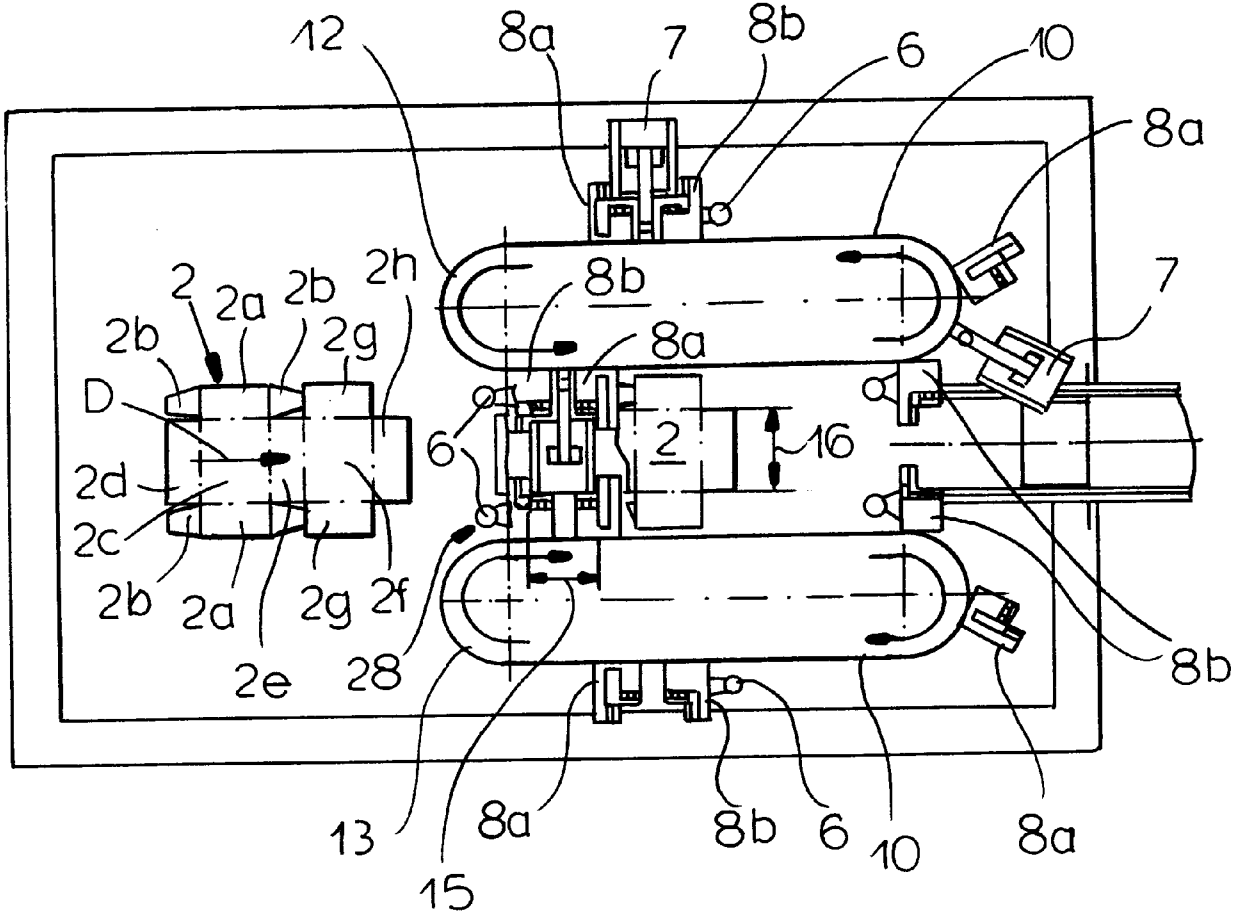
FIG. 2 is a top view of the apparatus of FIG. 1.

As seen in FIGS. 1 and 2 an apparatus 1 for setting up flat blanks 2 into boxes 3 has a magazine or supply system 4 comprising a horizontal conveyor 4*a* feeding a hopper 4*b* from which extends an angled output conveyor 5. Grippers 6 take the blanks 2 from the downstream end of the supply conveyor S and transport them horizontally in a travel direction D through the apparatus 1. Three die or tool assemblies 28 each comprising a pair of front tools 8*a* and a pair of back tools 8*b* both having pneumatic actuators 27 are mounted on each of two endless conveyor chains or belts 10 to travel on respective tracks 12 and 13 having stretches that flank the path followed by the blanks 2 through the apparatus 1.

Further tools 7 displaceable vertically by a guide rail path 11 between the respective pairs of tools 8*a* and 8*b* are also connected to the belt 10 of the guide 12 to move synchronously with the respective grippers 6 and the tools 8*a* and 8*b*. During the setting-up or erection process, all the tools 7, 8*a*, and 8*b* as well as the grippers 6, in fact everything that might make actual contact with the blank 2, move synchronously downstream with it. Thus there is no relative movement between the blank 2 and any parts that is not strictly necessary for folding it into a box 3.

More particularly as described in above-cited U.S. Pat. No. 5,269,741, the tools 8*a* and 8*b* first fold in the side panels 2*a* and afterward pivotal arms of the tools 8*a* fold in the side-panel end flaps 2*b*. Then the tool 7 acts as a punch and pushes the floor panel 2*c* of the box blank 2 down so as to fold up the front panel 2*d* and back panel 2*e* so they can be fixed to the side-panel end flaps 2*b*, forming the blank 2 into an upwardly open vessel from whose back panel 2*e* extends a top panel 2*f* with its side flaps 2*g* and front flap 2*h*. Once the box 3 thus formed is filled, the top panel 2*f* is folded down and its flaps 2*g* and 2*h* are folded in against the panels 2*a* and 2*d* to close the box 3.

An output conveyor 9 takes away the set up or erected boxes 3. In addition the tools 8*a* and 8*b* are provided with strippers 14 that facilitate taking the finished box 3 off them. A glue applicator 17 can be provided upstream of the setting up station so that flaps of the blank 2 are secured permanently in place.

In order to accommodate blanks 2 of different sizes a longitudinal spacing 15 and a transverse spacing 16 between the tools 8*a* and 8*b* can be adjusted. Such adjustment is a fairly simple matter as compared to that needed for the complex rail systems of the prior art.

Figure 3:
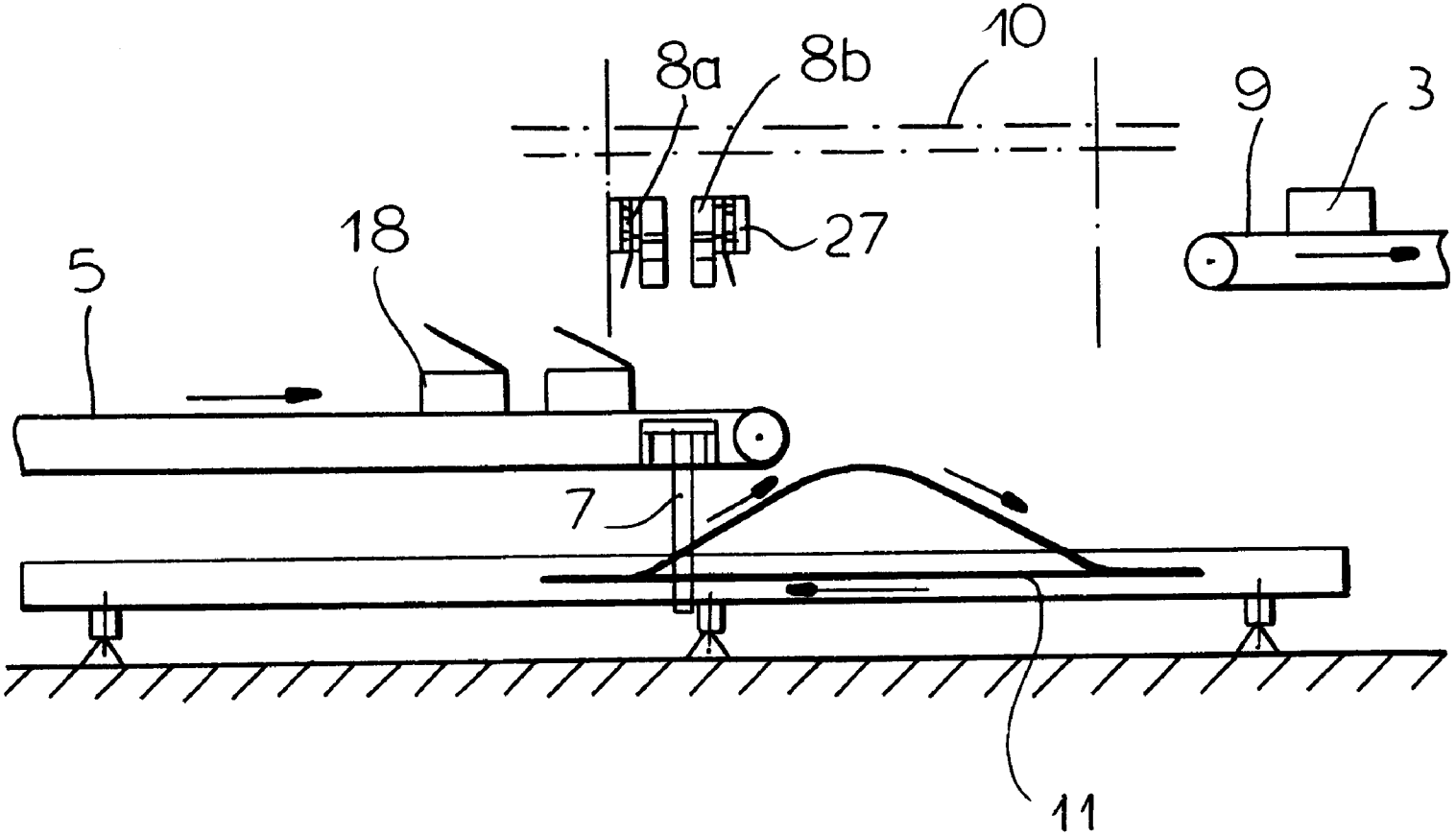
FIG. 3 is a side view of a detail on a variant on the system of FIGS. 1 and 2.

FIG. 3 shows how the apparatus can be fed a blank 18 with a partially open cover which is closed by downward movement of the tool 7.

Figure 4:
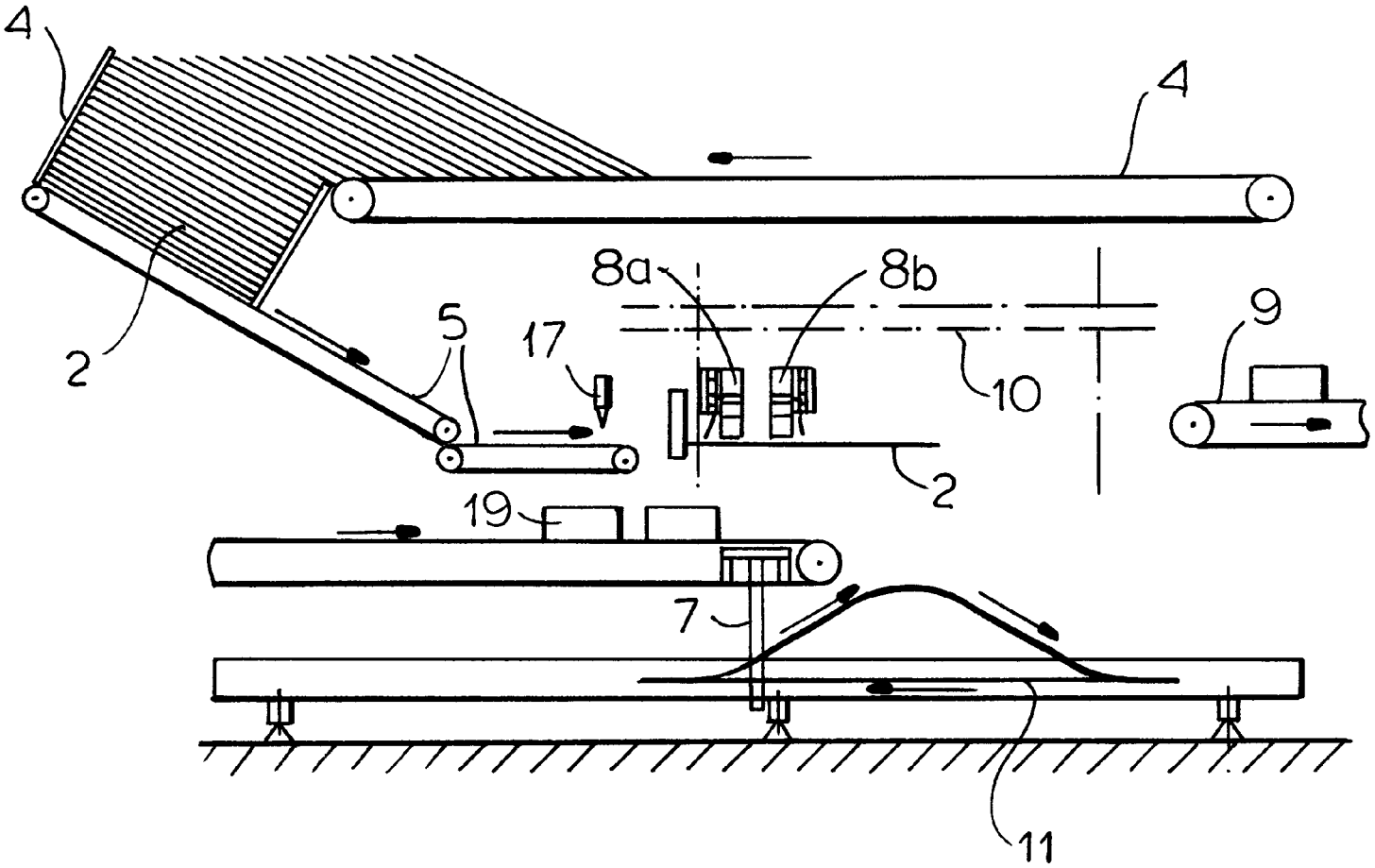
FIG. 4 is a side view of a detail on another variant on the system of FIGS. 1 and 2.

In FIG. 4 package 19 is fed to the apparatus so that the blank 2 is set up around it to contain it. To this end the blank 2 is set atop the package 19 and the tools 8*a* and 8*b* fit around the blank 2 and package 19 to set up the box 3.

We claim:

1. A method of continuously setting up flat box blanks into boxes, the method comprising the steps of:

feeding a succession of the blanks one at a time to a station;

gripping the blanks and pulling them one after another by means of grippers in a direction without stopping through the station;

moving a plurality of setup tools through the station in the direction synchronously with the grippers and the blanks; and engaging the continuously moving setup tools transversely with the blanks moving through the station to shape the moving blanks into boxes while holding the moving blanks in the station out of contact with any structure other than the synchronously moving tools and grippers.

2. An apparatus for setting up flat box blanks into boxes, the apparatus comprising:

supply means for feeding a succession of the blanks one at a time to a station;

means including at least one gripper for gripping the blanks and pulling them one after the other in a direction without stopping through the station;

means including a plurality of setup tools displaceable in the station transversely of the direction relative to the gripper;

transport means connected to the setup tools for displacing them in the direction synchronously with the gripper as the tools fold the blank held by the gripper into a box; and actuator means for displacing the tools transversely of the direction into engagement with the blanks held in the gripper and moving through the station and for folding the moving blanks into boxes while they are held by the grippers while holding the moving blanks in the station out of contact with any structure other than the synchronously moving tools and grippers.

3. The setting-up apparatus defined in claim 1 wherein the tools include fluid-powered actuators.

4. The setting-up apparatus defined in claim 1 wherein the transport means includes at least one endless conveyor element having a stretch extending in the direction through the machine and the tools and gripper are mounted on the element.

5. The setting-up apparatus defined in claim 4 wherein a plurality of sets of the tools and respective grippers are mounted on the element.

6. The setting-up apparatus defined in claim 5 wherein two such elements flank a path extending in the direction through the station and each such element carries a plurality of sets of tools and respective grippers.

7. The setting-up apparatus defined in claim 5 wherein a spacing between the tools in the direction can be varied.

8. The setting-up apparatus defined in claim 5 wherein a spacing between the tools transverse to the direction can be varied.

9. The setting-up apparatus defined in claim 1 wherein the tools include two front tools and two back tools spaced in the direction from the front tools.

10. The setting-up apparatus defined in claim 1, farther comprising means for applying an adhesive to flaps of the blank.

11. The setting-up apparatus defined in claim 1, further comprising means for taking set-up boxes from the gripper at a downstream side of the station.

12. The setting-up apparatus defined in claim 1, further comprising means for stripping set-up boxes from the tools.

13. The setting-up apparatus defined in claim 1, further comprising means for closing top panels of the boxes.

14. The setting-up apparatus defined in claim 1, further comprising means for feeding objects to be packaged to the station, the boxes being set up around the objects to be packaged.

* * * * *